US007460079B2

(12) United States Patent
Koyama et al.

(10) Patent No.: US 7,460,079 B2
(45) Date of Patent: Dec. 2, 2008

(54) GAME CHIP

(75) Inventors: Toshimi Koyama, Tokyo (JP); Nobuyuki Nonaka, Tokyo (JP); Jituo Migita, Kochi (JP)

(73) Assignees: Aruze Corp., Tokyo (JP); Seta Corp., Tokyo (JP); Minerva Corp., Kami-gun, Kochi (JP)

( * ) Notice: Subject to any disclaimer, the term of this patent is extended or adjusted under 35 U.S.C. 154(b) by 426 days.

(21) Appl. No.: 11/300,595

(22) Filed: Dec. 15, 2005

(65) Prior Publication Data

US 2006/0223638 A1 Oct. 5, 2006

(30) Foreign Application Priority Data

Dec. 20, 2004 (JP) ..... 2004-367240

(51) Int. Cl.
*H01Q 7/08* (2006.01)

(52) U.S. Cl. ..... 343/788

(58) Field of Classification Search ..... 343/788; 273/309, 288, 237

See application file for complete search history.

(56) References Cited

U.S. PATENT DOCUMENTS

| | | | | |
|---|---|---|---|---|
| 5,166,502 | A * | 11/1992 | Rendleman et al. | 235/492 |
| 5,361,885 | A * | 11/1994 | Modler | 194/214 |
| 5,651,548 | A | 7/1997 | French et al. | |
| 7,317,664 | B2 * | 1/2008 | Klein | 368/107 |
| 7,330,108 | B2 * | 2/2008 | Thomas | 340/505 |
| 7,357,299 | B2 * | 4/2008 | Frerking | 235/375 |
| 2006/0068878 | A1 * | 3/2006 | Krenn et al. | 463/17 |
| 2007/0197299 | A1 * | 8/2007 | Miller et al. | 463/43 |

FOREIGN PATENT DOCUMENTS

| | | |
|---|---|---|
| EP | 1 455 302 | 9/2004 |
| JP | 2003-085504 | 3/2003 |
| JP | 2003-196634 | 7/2003 |
| JP | 2004-021648 | 1/2004 |

* cited by examiner

*Primary Examiner*—Huedung Mancuso
(74) *Attorney, Agent, or Firm*—Leydig, Voit & Mayer, Ltd

(57) ABSTRACT

The present invention relates to the technology of recognizing and reading each game chip although game chips are stacked. The present invention is a game chip storing data readable by a reader/writer having an antenna which emits an electromagnetic wave and available in a stack of game chips, and includes: an IC device for communicating data at a request from the reader/writer, an antenna coil which is connected to the IC device, gets into electromagnetic coupling with an antenna of the reader/writer, can provide electric power to the IC device, is configured to enter a resonant state through an electromagnetic wave, and can transfer data to the reader/writer by load modulation, and a booster coil for configuring a resonant circuit by electromagnetic coupling through an electromagnetic wave from the reader/writer.

12 Claims, 5 Drawing Sheets

GAME CHIP

The present disclosure relates to subject matters contained in Japanese Patent Application No. 2004-367240 filed on Dec. 20, 2004, which are expressly incorporated herein by reference in its entireties.

BACKGROUND OF THE INVENTION

1. Field of the Invention

The present invention relates to a game chip, and more specifically to a game chip enabling data to be read by a read device such as an IC card reader/writer, etc.

2. Description of the Prior Art

Conventionally, among games familiar to a large number of people, there are games in which a player determines how much he or she bets by placing game chips at an optional position on a game table. A game of this type can be, for example, roulette, card games such as poker, blackjack, etc.

As various amusement facilities have become widespread, equipment that allows a gaming machine arranged in an amusement place and such as a game arcade, a casino, etc. to provide a player with more realistic and true-to-life feeling has been introduced, and a number of gaming machines of above-mentioned types have become popular in the market.

Some gaming machines of above-mentioned types request a player to input a target of a bet and the number of chips for the bet by pressing a button through a so-called control panel. These gaming machines are not accompanied by an operation of a player placing game chips, thereby lacking the realistic and real-to-life feeling in playing a game.

Accordingly, there is a proposed technology of embedding an IC chip and an IC tag in a game chip, reading the game chip containing the IC chip, etc. by a gaming machine using a reader/writer, and processing the read data as the input of a player. The technology is disclosed by, for example, Japanese Patent Laid-Open No. 2003-196634 (paragraph [0014]), Japanese Patent Laid-Open No. 2003-085504 (FIG. 1), Japanese Patent Laid-Open No. 2004-021648 (paragraph [0023], FIG. 7), etc.

SUMMARY OF THE INVENTION

Generally, a player at a gaming machine can bet for a target (for example, a specific number, red/black, odd/even, etc.) with any number of game chips. The player makes a bet by laying game chips of the number corresponding to the amount of bet determined by the player in a predetermined area (for example, an area assigned to each of the numbers 1 to 36, an area assigned to each of red/black, odd/even, etc.) on the game table.

In this case, the game chips are to be laid in an area corresponding to the bet target. However, when the number of game chips for a bet is large, the game chips may not be laid within the assigned area. In this case, the game chips are stacked like a tower in the area, thereby successfully laying the game chips within the desired area.

However, in a gaming machine operated in the technology of reading game chips using a reader/writer, when a game chips are stacked high, the upper game chips are distant from the reader/writer. Therefore, in the upper game chips or around them, the electromagnetic wave is scattered and attenuated to the level at which the information processing devices such as an IC chip, an IC tag, etc. which are loaded into a game chip and adopt the noncontact communication system cannot give a response. As a result, it becomes difficult or unstable for the reader/writer to recognize and read the game chips.

Furthermore, in a gaming machine in which adjacent areas are arranged as targets of a bet as in a roulette, when the effective communication distance of a reader/writer is set as a comparatively long distance, a game chip arranged in an adjacent area can also be read. Therefore, it is necessary to set the effective communication distance of a reader/writer as a somewhat short distance. Therefore, when game chips are stacked high, it is difficult to read upper game chips.

The present invention aims at providing game chips which can be correctly recognized and read when the game chips are used in a stack.

As means for solving the above-mentioned problems, the present invention has the following characteristics.

The first aspect of the present invention is to store data readable by a read device (for example, a reader/writer) having an antenna which emits an electromagnetic wave and to be proposed as a game chip available as stacked. The "game chip" referred to in this specification is a tool for use in indicating a target of a bet and the value of a valuable account (cash, credit, point, etc.) when the player expresses the intention to bet, and the "game chip" in this specification includes coin, medal, etc.

The game chip includes: circuit means (for example, an IC device, an IC chip, etc.) for communicating data with the read device in response to a request from the read device (for example, a reader/writer); antenna means (for example, an antenna, an antenna coil, etc.), which is connected to the circuit means, makes electromagnetic coupling with the antenna of the read device, thereby to provide electric power to the circuit means, and to enter a resonant state through an electromagnetic wave to transfer data to the read device by load modulation; and electromagnetic field resonant means (for example, a booster coil, etc.) configuring a resonant circuit through electromagnetic coupling with an electromagnetic wave from the read device.

The antenna means is connected to circuit means, and receives an electric wave from a read device or electromagnetic field resonant means described below. The electromagnetic field resonant means is adjusted before hand such that the means can enter a resonant state through an electromagnetic wave from the read device.

Generally, a conventional game chip can get into electromagnetic induction coupling with a read device and communicate data through an electric wave. However, when it is distant from the read device, electromotive force generated by an electric wave reaching an antenna connected directly to the chip from the read device cannot be sufficient for communication. The game chip according to the present invention resonates an electromagnetic field resonant means such as a booster coil by an electromagnetic wave transmitted from the read device by including the electromagnetic field resonant means, and resonates the coils of an antenna coil, a booster coil, etc. in another game chip nearby using the electromagnetic wave generated by the resonance of the electromagnetic field resonant means, thereby allowing the read device to read from a chip in the distance in which a read cannot be performed without electromagnetic field resonant means.

When the game chips are used in a stack, the resonance of the electromagnetic field resonant means in a lower position can resonate the electromagnetic field resonant means of the upper game chip, thereby guaranteeing a read of data from the game chips more correctly than in the conventional technology.

In the above-mentioned game chip, the electromagnetic field resonant means can also be a hollow coil arranged at a perimeter of the antenna means. With the configuration, the area of the electromagnetic field resonant means crossing the magnetic field generated from the read device can be enlarged, thereby fetching more flux.

The game chip according to the present invention may have a body member housing the circuit means, the antenna means, and the electromagnetic field resonant means.

The game chip according to the present invention may have a further feature that the circuit means is cylindrical, the antenna means is a hollow coil, and the electromagnetic field resonant means is a hollow coil, and wherein the circuit means, the antenna means and the electromagnetic field resonant means are arranged coaxially.

The game chip according to the present invention may has a further feature that the game chip further comprises a substrate on which the circuit means, the antenna means and the electromagnetic field resonant means are provided.

The accompanying drawings, which are incorporated in and constitute a part of the specification, illustrate embodiments of the invention, and together with the general description given above and the detailed description of the embodiments given below, serve to explain the principles of the invention.

DESCRIPTION OF THE PREFERRED EMBODIMENTS

The embodiments according to the present invention are described below in detail with reference to the drawings.

[1. Gaming Machine Processing Game Chips]

Figure 1:
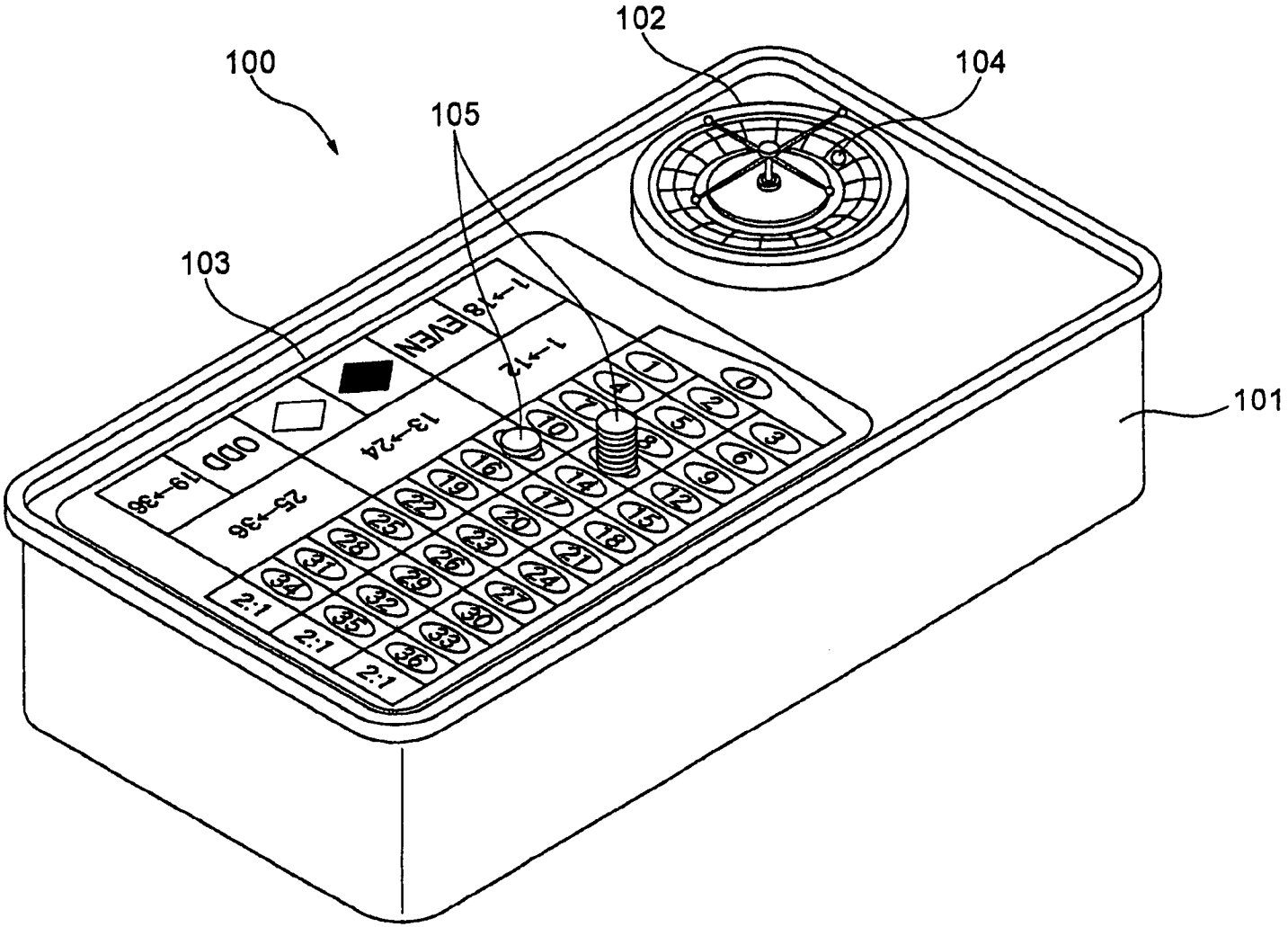
FIG. 1 is a perspective view of a gaming machine.

First, the gaming machine using the game chip according to the present embodiment is explained below. FIG. 1 is a perspective view of the gaming machine using the game chip according to the present embodiment.

A gaming machine 1 according to the present embodiment is a device for allowing a player to play roulette. As shown in FIG. 1, a gaming machine 100 has and a wheel 102 and a layout 103 at an upper surface of table-shaped gaming machine body 101. The wheel 102 has pockets respectively corresponding to the numbers of "0", "00", and "1" to "36". The layout 103 has a plurality of bet areas (area for designation of a target of a bet) corresponding to the numbers of "0", "00", and "1" to "36".

The player predicts which number of pocket a ball 104 thrown into a turning wheel 102 will enter, and lays a game chip 105 in any area in the layout 103 according to the prediction. By the operation of laying the game chip 105, the input of the bet in the gaming machine 100 is performed. If the prediction of the player comes true, the player can receive a dividend depending on the game chips laid for the bet.

Figure 2:
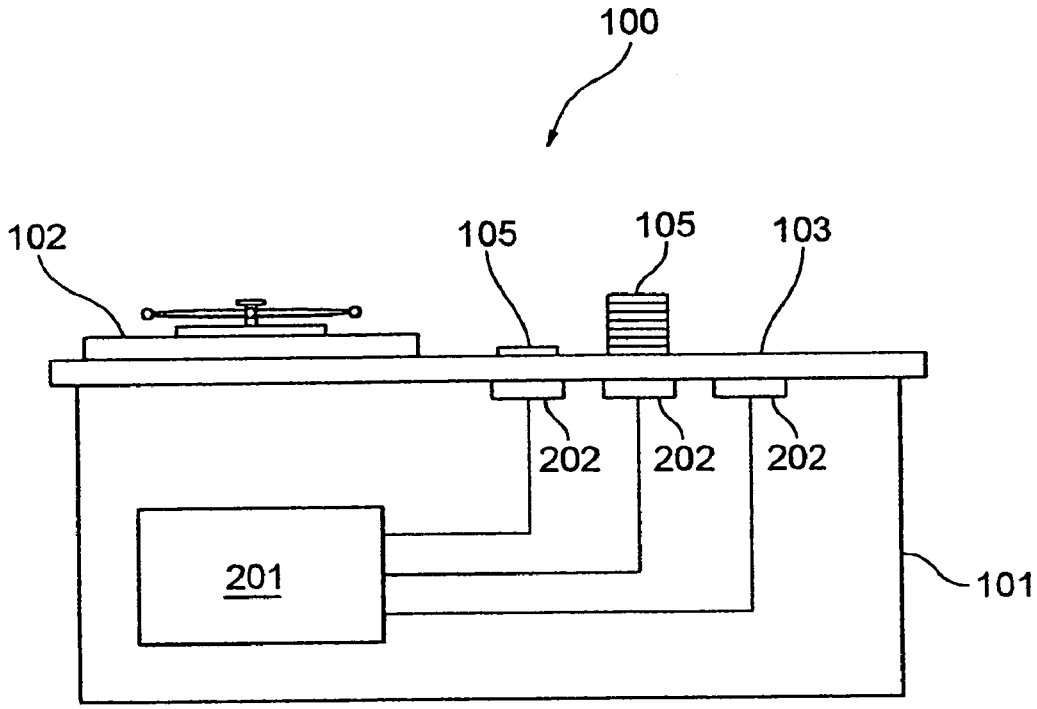
FIG. 2 is a functional block diagram of the gaming machine.

FIG. 2 is a functional block diagram showing the main internal configuration of the gaming machine 100. The gaming machine 100 includes a main control device 201 for control of the main operation of the gaming machine, and a plurality of readers/writers 202 provided under the layout 103 and corresponding to the respective bet areas.

The reader/writer 202 as a read device reads the information (ID information in the present embodiment) stored in the game chip 105 when the game chip 105 is laid in a bet area within its read range, and notifies the main control device 201 of the information. In this specification, it is referred to as a "reader/writer", but it is not always necessary to have a writing function. That is, a device having the function of reading data stored in the game chip 105 can be used as a "reader/writer" in this specification.

The ID information stored in the game chip 105 is the information uniquely designating the game chip 105. According to the ID information, it is discriminated that the game chip 105 relates to what value of which player. The information stored in the game chip 105 is not always ID information designating the game chip 105, but can be any information discriminating that the game chip 105 indicates what value of which player. For example, player ID information and chip value information (for example, the information indicating the value of one coin, the value of ten coins, the value of 100 coins, etc.) can be stored together in the game chip 105.

The main control device 201 recognizes which player makes a bet in which bet area by receiving read information from each reader/writer 202. The main control device 201 detects using a sensor (not shown in the attached drawings) provided in the wheel 102 about in which pocket the ball stops, determines the winning/losing status of each player and the dividend according to the information transmitted from the reader/writer 202 about which player makes a bet with how many chips laid in which bet area, and performs a game process such as adding a dividend to the credit of the player on the separately provided display device (not shown in the attached drawings) showing the payout.

[2. Example of Configuration of Game Chip]

Figure 3A:
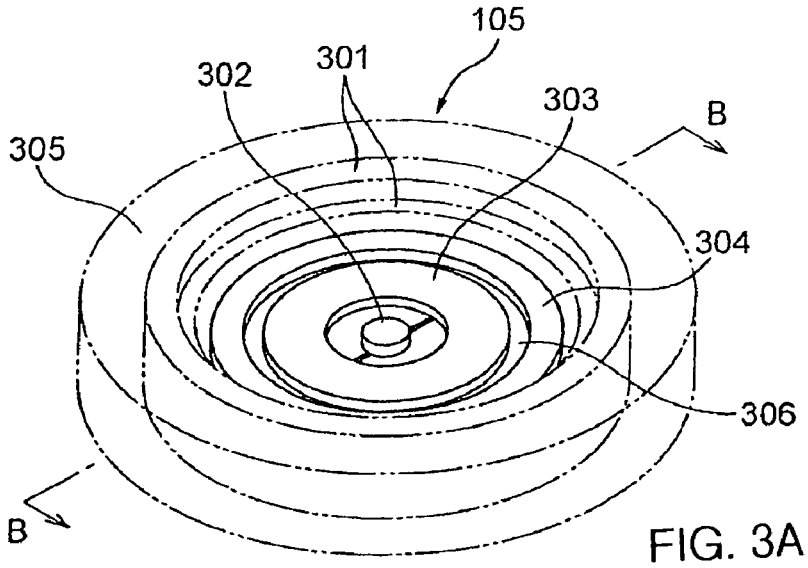
FIG. 3A is a perspective view of a game chip.
Figure 3B:
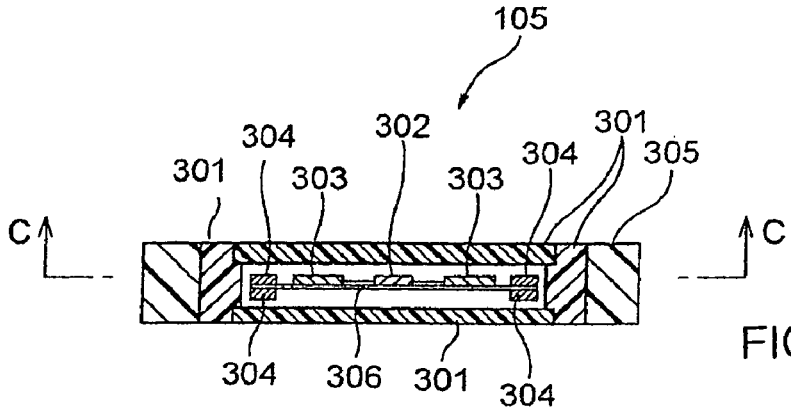
FIG. 3B is a sectional view along the line B-B in FIG. 3A.
Figure 3C:
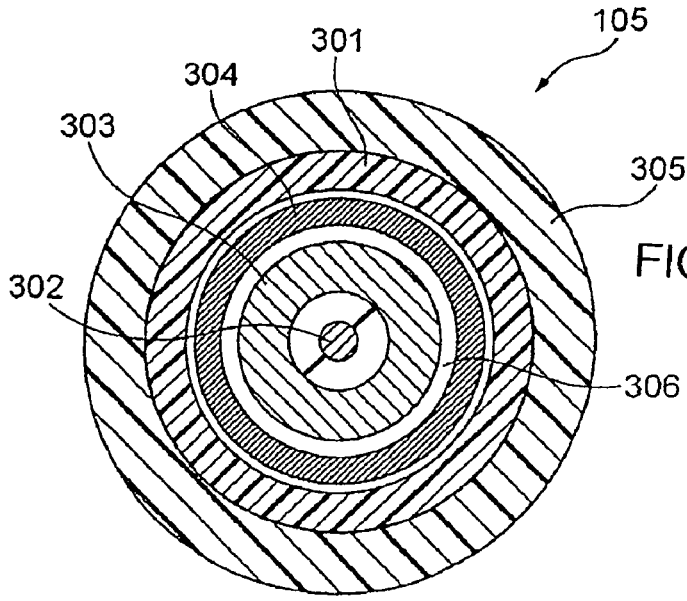
FIG. 3C is a sectional view along the line C-C in FIG. 3B.

The example of the configuration of the game chip 105 according to the present embodiment is explained below by referring to FIGS. 3A to 3C. FIG. 3A is a perspective view of the game chip 105. FIG. 3B is a sectional view along the sectional line B-B shown in FIG. 3A. FIG. 3C is a sectional view along the sectional line C-C shown in FIG. 3B.

As shown in FIGS. 3A to 3C, the game chip 105 includes a body 301 formed by a resin, etc., and a protection ring 305 as a cylindrical member for protection of the body 301. The body 301 stores the substrate 306. The substrate 306 is loaded with an IC device 302 as circuit means, an antenna coil 303 as antenna means connected to the IC device 302, and a booster coil 304 as electromagnetic field resonant means which is not connected to the IC device 302 and not electrically connected to the antenna coil 303.

The IC device 302 is an electronic part designed to perform a processing function, a storage function, and an input/output control function, and has the function of passing stored information to the reader/writer 202 at a request from the reader/writer 202.

The antenna coil 303 performs communication of a signal between the reader/writer 202 and the game chip 105, converts a carrier wave from the reader/writer 202 to electric power, and provides the power for the IC device 302.

The booster coil 304 is configured such that it can make electromagnetic coupling with a modulated electromagnetic wave from the reader/writer 202, and makes electromagnetic coupling with the antenna coil 303 connected to the IC device 302 distant from the reader/writer 202, thereby passing the information in the IC device 302 to the reader/writer 202.

The form and the arrangement position of the booster coil 304 are not limited to those shown in FIG. 3, but the coil can be circular, rectangular, or polygonal.

It is not necessary that the booster coil 304 stores the IC device 302 and the antenna coil 303 in its center so far as it is inside the booster coil 304. It is also not necessary that they are coplanar.

[3. Example of Operation of Game Chip]

Described below is an example of an operation of the game chip 105.

Figure 4:
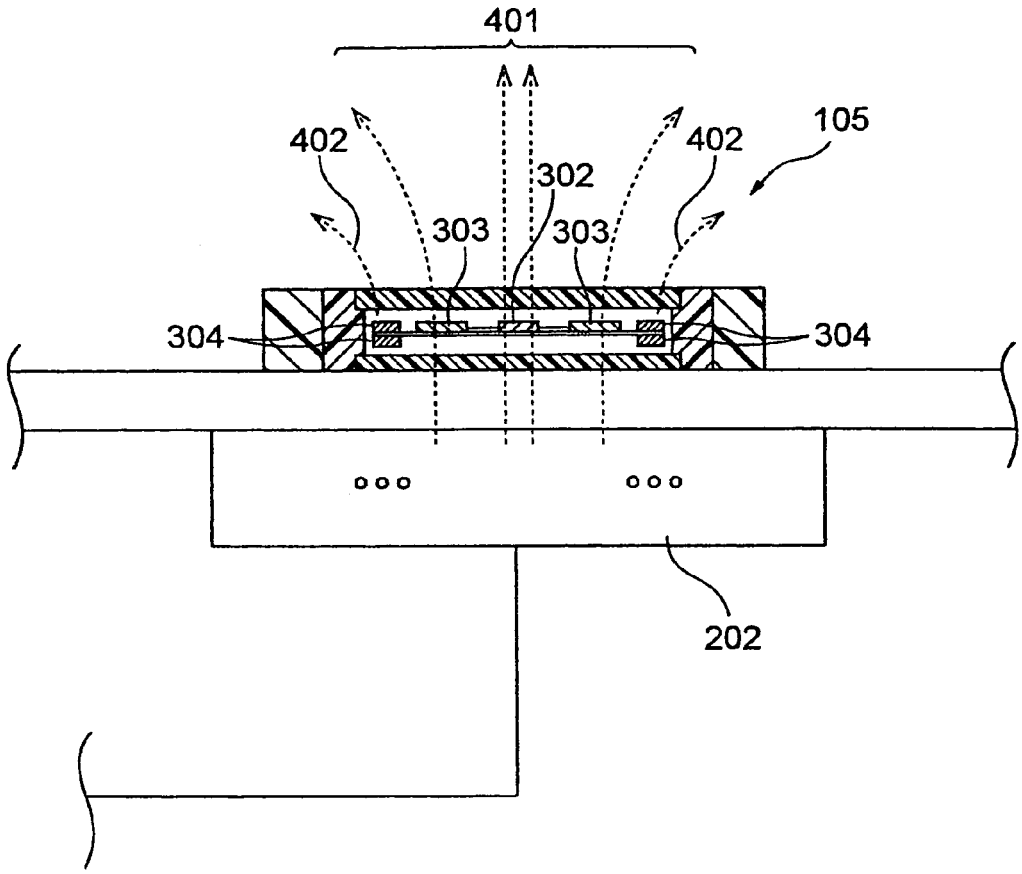
FIG. 4 shows a magnetic field generated when a reader/writer reads a game chip.

FIG. 4 shows the status of a magnetic field generated when the reader/writer 202 reads the game chip 105 placed on the layout 103.

The reader/writer 202 generates a high frequency (for example, 13.56 MHz) as a carrier wave, modulates and amplifies power of the carrier wave according to the baseband signal corresponding to transmission data, provides the wave for an antenna, and emits it as an electromagnetic field from the antenna. By the electromagnetic induction effect of the magnetic field 401 generated by the emission of the carrier wave, induced current is generated in the antenna coil 303, and the induced current provides electric power for the game chip 105 (IC device 302).

On the other hand, the game chip 105 receives an electric wave from the antenna connected to the reader/writer 202, and the antenna of the reader/writer 202 and the antenna coil 303 connected to the IC device 302 get into electromagnetic coupling status. The IC device 302 in the game chip 105 can transmit data from the IC device 302 to the reader/writer 202 by load modulation.

Figure 5:
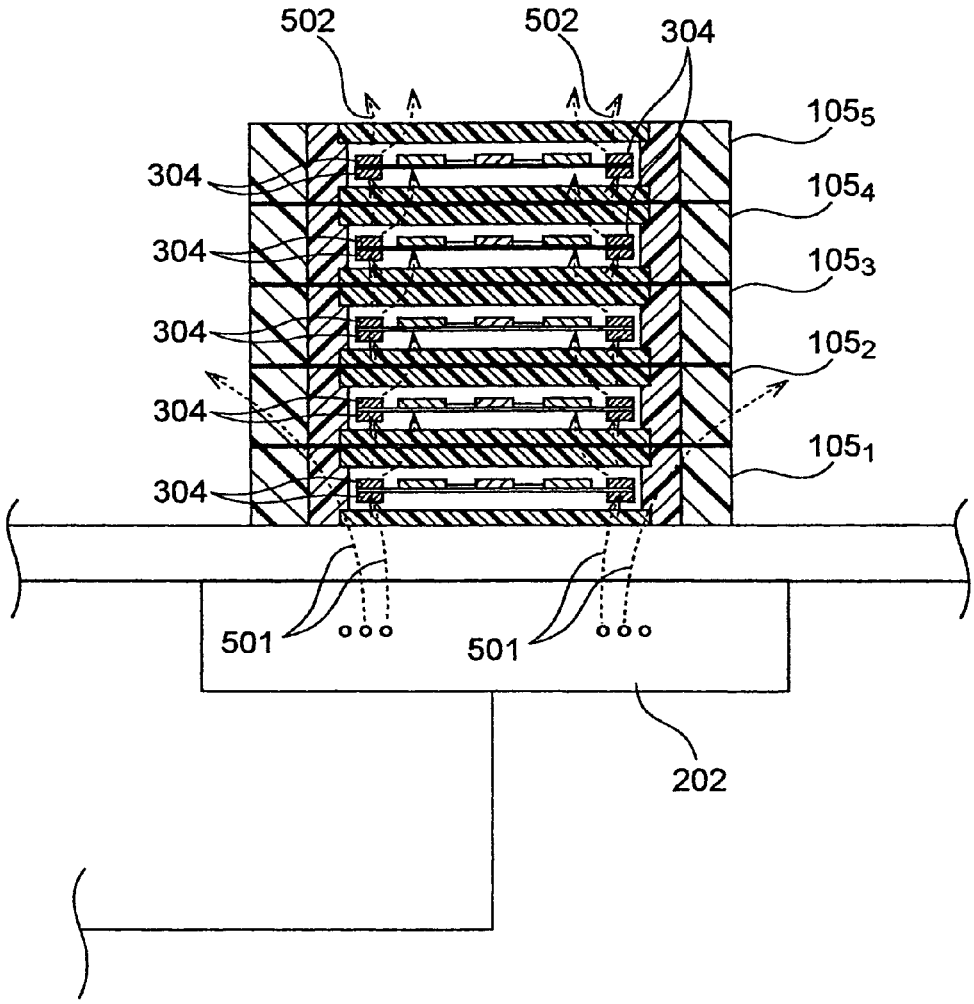
FIG. 5 shows a magnetic field generated when a reader/writer reads a game chip.

The state when the reader/writer 202 reads the game chip 105 placed on the layout 103 with a plurality of game chips 105 stacked is explained below by referring to FIG. 5. FIG. 5 shows an example of the state when the game chip 105 is read with the chips stacked. It is obvious that the IC device 302 having the anti-collision capability corresponding to a read of a plurality of game chips is used when the plurality of game chips 105 are read.

In the example shown in FIG. 5, a stack of five game chips $\mathbf{105}_1$ to $\mathbf{105}_5$ is read by the reader/writer 202. In this example, using the electromagnetic wave transmitted from the antenna of the reader/writer 202, only the chips up to the game chip $\mathbf{105}_4$ can be read.

Upon receipt of an electromagnetic wave transmitted from the antenna of the reader/writer 202, the booster coil 304 of the game chip $\mathbf{105}_4$ configures a resonant circuit by electromagnetic coupling. At this time, assume that the IC device 302 of the game chip $\mathbf{105}_4$ has completed a read, and has entered a stop mode. With the resonance of the booster coil 304 nearby, the booster coil 304 incorporated into the game chip $\mathbf{105}_5$ stacked above gets into electromagnetic coupling with the booster coil 304 of the game chip $\mathbf{105}_4$, the booster coil 304 of the game chip $\mathbf{105}_5$ and the antenna coil 303 connected to the IC device 302 incorporated into the game chip $\mathbf{105}_5$ also get into electromagnetic coupling, thereby configuring a resonant circuit. Thus, the game chip $\mathbf{105}_5$ not conventionally read can be operated.

That is, the game chip 105 according to the present embodiment can expand the electromagnetic coupling status by the booster coil 304 although the game chips are stacked and are out of the effective communication range of the reader/writers 202. Therefore, the stacked game chips 105 in upper positions can communicate with the reader/writer 202. As a result, the data stored in the game chips 105 can be read.

The present invention has been explained as a game chip applied to a gaming machine, but the present invention is not limited to a game chip, and can be applied to all devices in a noncontact communication system using electromagnetic coupling such as an IC card, an IC tag, etc.

[Advantages of the Invention]

According to the present invention, although game chips are stacked, the game chips can be correctly recognized, and the data or information stored in the game chips can be successfully read.

Additional advantages and modifications will readily occur to those skilled in the art. Therefore, the invention in its broader aspects is not limited to the specific details or representative embodiments shown and described herein. Accordingly, various modification may be made without departing from the spirit or cope of the general inventive concept as defined by the appended claims and their equivalents.

What is claimed is:

1. A game chip storing data readable by a read device having an antenna which emits electromagnetic waves, the game chip comprising:

a circuit for supplying data stored in the circuit to the read device in response to a request from the read device;

an antenna connected to the circuit and coupling electromagnetically with the antenna of the read device, to provide electric power to the circuit from the read device, and to supply the stored data to the read device through the antenna of the read device; and an electromagnetic field resonant member for resonant electromagnetic coupling with the antenna of the read device in response to electromagnetic waves received from the read device, wherein, when the game chip is in a stack of a plurality of the game chips and is outside effective communication range of the read device, electric power is provided to the game chip from the read device and data stored in the game chip is supplied to the read device, through the electromagnetic field resonant members of the other game chips in the stack, by electromagnetic coupling of the electromagnetic field resonant members in the stack.

2. The game chip according to claim 1, wherein the game chip has a body member housing the circuit, the antenna of the game chip, and the electromagnetic field resonant member.

3. The game chip according to claim 2, wherein the circuit is cylindrical, the antenna of the game chip includes a hollow coil, and the electromagnetic field resonant member includes a hollow coil, and the circuit, the antenna of the game chip, and the electromagnetic field resonant member are coaxial.

4. The game chip according to claim 3, wherein the game chip further comprises a substrate on which the circuit, the antenna of the game chip, and the electromagnetic field resonant member are located.

5. The game chip according to claim 1, wherein the electromagnetic field resonant member resonates with the antenna of the game chip by electromagnetic induction.

6. The game chip according to claim 5, wherein the electromagnetic field resonant member includes a hollow coil surrounding the antenna of the game chip.

7. The game chip according to claim 5, wherein the game chip has a body member housing the circuit, the antenna of the game chip, and the electromagnetic field resonant member.

8. The game chip according to claim 7, wherein the circuit is cylindrical, the antenna of the game chip includes a hollow coil, and the electromagnetic field resonant member includes a hollow coil, and the circuit, the antenna of the game chip, and the electromagnetic field resonant member are coaxial.

9. The game chip according to claim 8, wherein the game chip further comprises a substrate on which the circuit, the antenna of the game chip, and the electromagnetic field resonant member are located.

10. The game chip according to claim 1, wherein the antenna of the game chip includes an antenna coil surrounding the circuit, the electromagnetic field resonant member includes a booster coil surrounding the antenna coil of the game chip, the game chip includes a substrate having opposed first and second faces and disposed within the game chip, the circuit and the antenna coil are disposed on the first face of the substrate, and the booster coil is disposed on both of the first and second faces of the substrate.

11. A gaming apparatus comprising:

a gaming apparatus main body including a plurality of contiguous bet areas on a first side of the gaming apparatus main body;

a plurality of read devices located on a second side of the gaming apparatus main body and arranged in correspondence with respective bet areas, the read devices generating electromagnetic waves propagated only in the corresponding bet area for reading information;

a plurality of game chips which can be stacked in the respective bet areas and which store ID information and chip information for reading by the read device for the corresponding bet area where the game chips are placed, wherein each game chip includes a circuit for supplying data stored in circuit to one of the read devices in response to a request from the read device, an antenna connected to the circuit and coupling electromagnetically with the antenna of one of the read devices, to provide electric power to the circuit from the read device, and to supply the stored data to the read device through the antenna of the read device, and an electromagnetic field resonant member for resonant electromagnetic coupling with the antenna of one of the read devices in response to electromagnetic waves received from the read device, wherein, when the game chip is in a stack of a plurality of the game chips and is outside effective communication range of the read device, electric power is provided to the game chip from the read device and data stored in the game chip is supplied to the read device, through the electromagnetic field resonant members of the other game chips in the stack, by electromagnetic coupling of the electromagnetic field resonant members in the stack; and a controller controlling the read devices, the controller receiving ID information read from game chips placed on the bet areas and read by the corresponding read device, including from game chips in stacks placed on respective bet areas, specifying a player placing a bet in one of the bet areas by placing at least one game chip in the bet area from the ID information read by the corresponding read device, and determining a payment to a player in response to a game result, based on game chips placed on a respective bet area by the player.

12. A gaming apparatus comprising:

a gaming apparatus main body including a plurality of contiguous bet areas on a first side of the gaming apparatus main body;

a rotatable roulette wheel having a plurality of pockets, and a plurality of sensors, each sensor corresponding to a respective bet area and a respective pocket;

a ball which may come to rest in any one of the pockets of the roulette wheel and which is detectable in position by the sensors;

a plurality of read devices located on a second side of the gaming apparatus main body and arranged in correspondence with respective bet areas, the read devices generating electromagnetic waves propagated only in the corresponding bet area for reading information;

a plurality of game chips which can be stacked in the respective bet areas and which store ID information and chip information for reading by the read device for the corresponding bet area where the game chips are placed, wherein each game chip includes a circuit for supplying data stored in the circuit to one of the read devices in response to a request from the read device, an antenna connected to the circuit and coupling electromagnetically with the antenna of one of the read devices, to provide electric power to the circuit from the read device, and to supply the stored data to the read device through the antenna of the read device, and an electromagnetic field resonant member for resonant electromagnetic coupling with the antenna of one of the read devices in response to electromagnetic waves received from the read device, wherein, when the game chip is in a stack of a plurality of the game chips and is outside effective communication range of the read device, electric power is provided to the game chip from the read device and data stored in the game chip is supplied to the read device, through the electromagnetic field resonant members of the other game chips in the stack, by electromagnetic coupling of the electromagnetic field resonant members in the stack; and a controller controlling the read devices, the controller receiving ID information read from game chips placed on the bet areas and read by the corresponding read device, including from game chips in stacks placed on respective bet areas, controlling rotation of the roulette wheel, receiving from the sensors game result information indicative of which of the pockets contains the ball, and determining a payment to a player placing a bet using at least one of the game chips in a bet area corresponding to the pocket containing the ball and based upon the ID information received from the read devices and the game result information received from the sensors.

* * * * *